US005447255A

United States Patent [19]

Smedley

[11] Patent Number: 5,447,255

[45] Date of Patent: Sep. 5, 1995

[54] TOOTHPASTE DISPENSING APPARATUS

[76] Inventor: Robert S. Smedley, 3524 E. Lake St., Shreveport, La. 71105

[21] Appl. No.: 387,295

[22] Filed: Feb. 10, 1995

[51] Int. Cl.[6] ..... B65D 35/28

[52] U.S. Cl. ..... 222/102; 222/96; 222/336; 222/511

[58] Field of Search ..... 222/95, 96, 101, 102, 222/105, 336, 339, 340, 511, 552, 559

[56] References Cited

U.S. PATENT DOCUMENTS

| | | | |
|---|---|---|---|
| 1,728,147 | 9/1929 | Windsor | 222/102 |
| 1,832,287 | 11/1931 | Errig | 222/103 |
| 1,891,292 | 12/1932 | VanBuren | 222/102 |
| 2,537,872 | 1/1951 | Wright | 222/511 X |
| 2,625,302 | 1/1953 | Mahoney | 222/511 X |
| 2,634,026 | 4/1953 | Yuan | 222/511 X |
| 2,684,183 | 7/1954 | Werner | 222/511 X |
| 2,734,662 | 2/1956 | Shippen | 222/102 |
| 2,848,141 | 8/1958 | Intagliata | 222/336 X |
| 2,876,934 | 3/1959 | Brim | 222/102 |
| 2,901,147 | 8/1959 | Bond, Jr. | 222/102 |
| 3,289,893 | 12/1966 | Vance et al. | 222/102 |
| 3,471,668 | 10/1969 | Wilkes | 222/102 X |
| 3,701,459 | 10/1972 | Ward | 222/102 |
| 4,418,840 | 12/1983 | Gardner, Sr. | 222/102 X |
| 5,100,025 | 3/1992 | McGraw | 222/95 |
| 5,203,473 | 4/1993 | Willey | 222/94 |
| 5,323,932 | 6/1994 | Bauman | 222/96 |

OTHER PUBLICATIONS

*Primary Examiner*—Kevin P. Shaver
*Attorney, Agent, or Firm*—John M. Harrison

[57] ABSTRACT

A toothpaste dispensing apparatus which is designed to enclose a disposable toothpaste tube and sequentially dispense toothpaste from the tube spout by operation of a pair of spring-loaded rollers. The apparatus includes a container having a pair of longitudinal slots, a removable cap and a toothpaste dispensing valve in the cap for registering with the threaded toothpaste tube spout and dispensing toothpaste from the tube spout on demand. A pair of rollers is disposed in the apparatus and the rollers are attached to oppositely-disposed, spring-loaded roller tabs at the container slots, wherein the rollers seat on opposite sides of the toothpaste tube inserted in the apparatus and are biased upwardly against the toothpaste tube by the springs. The springs are sufficiently strong to exert constant pressure on the toothpaste tube and the encapsulated toothpaste and facilitate dispensing of a controlled quantity of toothpaste from the tube spout upon manipulation of the toothpaste dispensing valve.

20 Claims, 1 Drawing Sheet

TOOTHPASTE DISPENSING APPARATUS

BACKGROUND OF THE INVENTION

1. Field of the Invention

This invention relates to toothpaste dispensing devices and more particularly, to a semi-automatic toothpaste dispensing apparatus which is characterized by a longitudinally-slotted container for removably receiving a disposable tube of toothpaste and spring-biased rollers located in the container and engaging the toothpaste tube for constantly applying pressure to the tube and facilitating dispensing of the pressurized toothpaste from the tube spout through a valve located in a cap removably mounted on the toothpaste dispensing apparatus. In a preferred embodiment a pair of oppositely-disposed tabs extend from an accessible position outside the container, through the longitudinal slots in the container and the tabs are attached to the rollers. A pair of coil springs are mounted in the container and are connected to the tabs for constantly biasing the rollers against the toothpaste tube when the toothpaste tube is inserted in the container in vertical orientation, with the tube spout engaging the container cap. A spring-loaded, push-pull valve located in the cap attached to the dispensing apparatus container serves to dispense toothpaste from the tube and tube spout onto a toothbrush, on demand.

One of the problems involved in the process of brushing ones' teeth is dealing with a nearly-empty toothpaste tube as residual toothpaste is dispensed from the tube. When approximately half the toothpaste has been dispensed from a conventional disposable tube, the tube must be rolled or otherwise compressed from the bottom end upwardly or pressure must be otherwise applied to the remaining toothpaste in the tube, to facilitate flow of additional toothpaste through the dispensing opening. The problem is magnified as additional toothpaste is forced from the tube, particularly under circumstances where the tube is constructed of plastic, since plastic tubes cannot be effectively rolled and maintained in a rolled position to isolate the residual quantity of toothpaste near the dispensing opening or spout. Accordingly, a significant amount of toothpaste in each toothpaste tube must be discarded with the tube because of the lack of facility for effectively trapping and removing the residual toothpaste in that portion of the tube lying adjacent to the dispensing spout.

2. Description of the Prior Art

Various types of toothpaste ejectors or dispensers are known in the art. U.S. Pat. No. 1,728,147, dated Sep. 10, 1929, to P.H.D. Winsor, details a "ToothPaste Ejector". The ejector includes a frame which receives a disposable toothpaste tube and a pair of rollers are located on each side of the tube, with a rolling pin and knob attached to the rollers for manually forcing the rollers toward the top of the tube to dispense toothpaste from the tube spout. U.S. Pat. No. 1,832,287, dated Nov. 17, 1931, to W. F. Errig, details a "Dispenser" for containing a disposable tube of toothpaste, which dispenser is provided with a wedge-shaped, hinge-type pressure-exerting apparatus manipulated by the fingers to selectively apply pressure to the toothpaste tube and eject toothpaste from the tube on demand. Another dispenser is detailed in U.S. Pat. No. 1,891,292, dated Dec. 20, 1932, to A.D. Van Buren. The device includes a pair of rollers located on each side of a toothpaste tube removably positioned in a container and a pair of threaded rods and connecting knobs are provided in the container for manipulation by a user and forcing the rollers against the tube to selectively dispense toothpaste from the tube. U.S. Pat. No. 2,876,934, dated Mar. 10, 1959, to B. J. Brim, details a "Collapsible Tube Squeezer" which also uses a pair of rollers that engage a disposable tube of toothpaste located inside a container, wherein the rollers are manipulated against the toothpaste tube by means of a ratchet mechanism. Operation of the ratchet mechanism on demand sequentially dispenses toothpaste from the tube in selected quantities. Another "Dispensing Device for Tubular Containers" is detailed in U.S. Pat. No. 3,289,893, dated Dec. 6, 1966, to R. K. Vance, et al. The device uses a pair of rollers for engaging a tube of toothpaste located in a container, wherein the rollers are selectively manipulated against the toothpaste tube by means of a knob attached to one of the rollers, to sequentially force toothpaste from the tube. U.S. Pat. No. 3,701,459, dated Oct. 31, 1972, to Ernest Ward, details a "Tube Paste Squeezer For ToothPaste and the Like". The device is capable of being mounted on the wall of a bathroom and used for dispensing either toothpaste or shaving cream in a more efficient manner. The apparatus includes a case, within which the tube is fitted to be fed between a pair of rollers that are manually rotated by an external crank handle outside the case, so that the paste can be dispensed from the bottom of the device. Another "ToothPaste Dispenser Apparatus" is detailed in U.S. Pat. No. 5,203,473, dated Apr. 20, 1993, to Carlton B. Willey. The device includes a housing having slots on opposite sides that receive a knob and axle member for engaging a toothpaste tube located in the housing. The knob and axle member is manually forced against the toothpaste tube to eject toothpaste from the tube on demand. Alternatively, a rack and gear structure can be utilized to force the knob and axle member against the toothpaste tube and dispense the toothpaste.

It is an object of this invention to provide a new and improved toothpaste dispensing apparatus which utilizes a pair of spring-biased rollers mounted in a container and engaging a tube of toothpaste, along with a valve provided in the dispensing end of the container and communicating with the open end or spout of the toothpaste tube to selectively dispense toothpaste from the tube by manipulation of the valve.

Another object of the invention is to provide a valve-operated toothpaste dispensing apparatus which includes a housing or container fitted with a pair of oppositely-disposed, longitudinal slots, a pair of rollers located in the container for engaging opposite sides of a disposable toothpaste tube fitted in the container, with a pair of roller tabs extending through the container slots and attached to the rollers and spring-loaded to force the rollers against the toothpaste tube, and a valve provided in the dispensing apparatus cap or lid, which valve communicates with the open spout of the toothpaste tube to facilitate selectively dispensing toothpaste from the tube and spout by operation of the spring-loaded rollers and manipulation of the valve.

Still another object of this invention is to provide a toothpaste dispensing apparatus for semi-automatically dispensing toothpaste on a toothbrush from a disposable toothpaste tube, which apparatus includes an upright container having a removable lid fitted with a slide valve, a pair of oppositely-disposed, vertical slots provided in the container for receiving spring-loaded tabs connected to rollers located on opposite sides of a toothpaste tube removably disposed in the container, with the open spout of the toothpaste tube communicating with the slide valve, such that selective manipulation of the slide valve causes toothpaste to dispense from the slide valve and the tube spout responsive to pressure constantly exerted on the toothpaste tube by the spring-loaded rollers.

SUMMARY OF THE INVENTION

These and other objects of the invention are provided in a new and improved toothpaste dispensing apparatus which, in a preferred embodiment, includes an elongated, upright tube, housing or container having a removable top or cap fitted with a slide valve and a dispensing aperture, a pair of vertical slots provided in the container in oppositely-disposed, parallel relationship with respect to each other for accommodating oppositely-disposed, external roller tabs extending through the slots, respectively, and connected to corresponding rollers located inside the container. The rollers are disposed on opposite sides of a disposable tube of toothpaste removably fitted in the container, the open end or spout of which toothpaste tube communicates with the slide valve and the dispensing aperture in the cap and a pair of coil springs are located in the container adjacent to the slots, respectively, for connecting the rollers and tabs to the top of the apparatus housing and constantly applying pressure to the toothpaste tube by the rollers to facilitate controlled dispensing of toothpaste from the toothpaste tube responsive to finger manipulation of the slide valve.

BRIEF DESCRIPTION OF THE DRAWINGS

The invention will be better understood by reference to the accompanying drawing, wherein.

DESCRIPTION OF THE PREFERRED EMBODIMENTS

Figure 2:
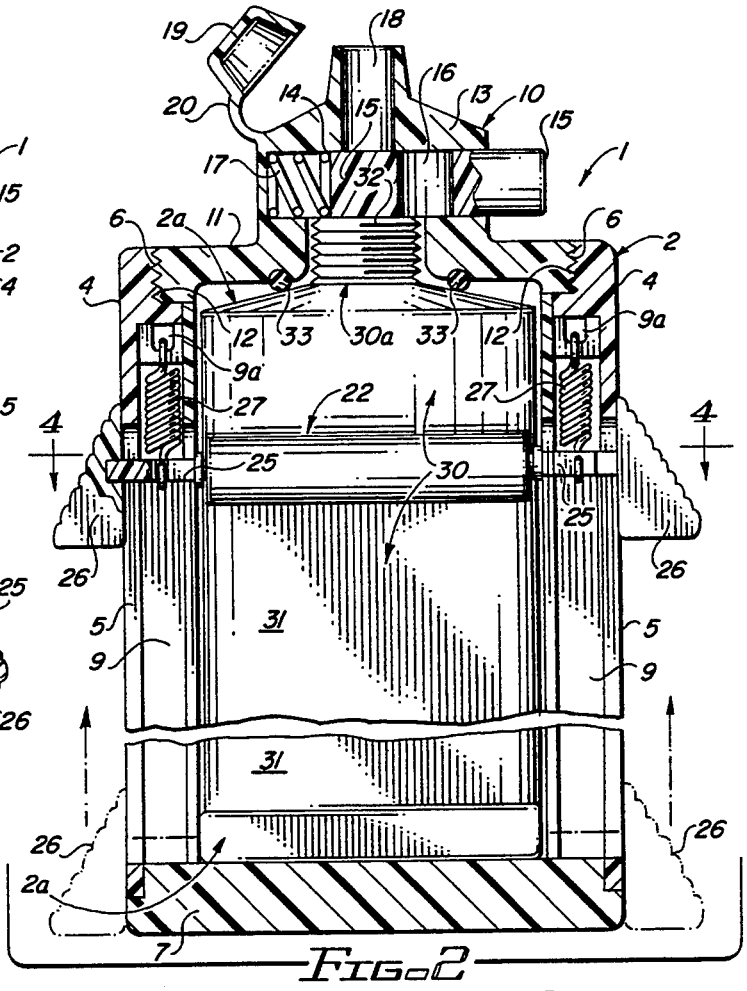
FIG. 2 is a longitudinal sectional view, taken along line 2—2 of the toothpaste dispensing apparatus illustrated in FIG. 1.

Referring to the drawing, the toothpaste dispensing apparatus of this invention is generally illustrated by reference numeral 1 and includes a substantially cylindrical container 2, having a container interior 2*a* and shaped to define oppositely-disposed, rounded walls 3 and corresponding oppositely-disposed, flat walls 4, adjoining the rounded walls 3. Each of the flat walls 4 includes a vertical, elongated wall slot 5 and the top end of the container 2 is fitted with internal container threads 6 for receiving the external cap base threads 12 of a flat cap base 11 element of a cap 10, removably mounted on the top of the container 2. A container bottom 7 fixedly closes the bottom of the container 2 and in a most preferred embodiment, the container shoulder 8 of the container 2 is substantially co-planar with the corresponding cap base 11 of the cap 10 when the cap 10 is threadably mounted on the container 2 by engaging the cap base threads 12 with the corresponding container threads 6. A spring slot 9 is provided in the container interior 2*a* adjacent to each of the flat walls 4 and the wall slots 5, to accommodate a pair of roller coil springs 27, having one end attached respectively to a spring mount 9*a* located at the top of each the spring slots 9, as illustrated in FIG. 2. The cap base 11 of the cap 10 includes a valve base 13, having a horizontal valve base aperture 14 which receives a cylindrical valve 15, that slides inside the valve base aperture 14, as hereinafter further described. A valve spring 17 is provided in one end of the valve base aperture 14 and seats against the valve 15, which is further fitted with a vertically-oriented transverse valve opening 16. The opposite end of the valve 15 from the valve spring 17 protrudes beyond the plane of the valve base 13 to facilitate slidable manipulation of the valve 15 inside the valve base aperture 14, for purposes which will be hereinafter described. A vertical dispensing aperture 18 is provided in the upper end of the valve base 13 of the cap 10 and the dispensing aperture 18 is normally closed from communication with the container interior 2*a* of the container 2, by means of that normally closed portion of the valve 15 which extends between the valve spring 17 and the transverse valve opening 16, as further illustrated in FIG. 2. Accordingly, referring again to FIG. 2 of the drawing, the valve 15 can be slidably manipulated in the valve base aperture 14 against the bias of the valve spring 17 by finger pressure applied to the extending end of the valve 15, to momentarily align the vertical transverse valve opening 16 with the vertical dispensing aperture 18 in the valve base 13 and facilitate communication between the dispensing aperture 18 and the container interior 2*a* of the container 2, as hereinafter further described. An aperture cap 19 is attached by means of a flexible cap tether 20 to the valve base 13, to facilitate removably closing the dispensing aperture 18 when the toothbrush dispensing apparatus 1 is not in use.

Figure 4:
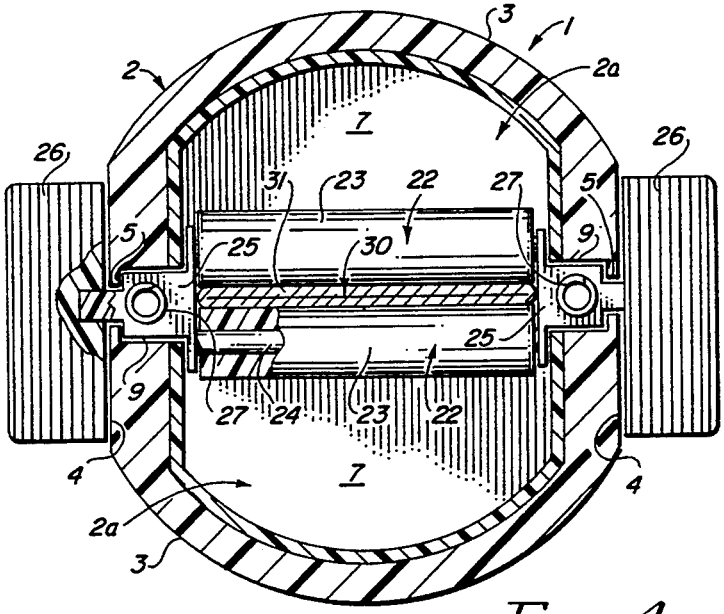
FIG. 4 is a sectional view taken along line 4—4 of the toothpaste dispensing apparatus illustrated in FIG. 2.

Referring now to FIGS. 2 and 4 of the drawing, a pair of tube rollers 22 are transversely positioned inside the container 2 in parallel, spaced relationship with respect to each other. The roller pins 24 of the tube rollers 22 are connected to a pair of common roller mounts 25, which extend through the respective wall slots 5 in the flat walls 4 of the container 2 and terminate in support of a pair of external roller tabs 26. Contact cylinders 23 of the tube rollers 22 are freely rotatable on the roller pins 24, for purposes which will be hereinafter further described.

Figure 1:
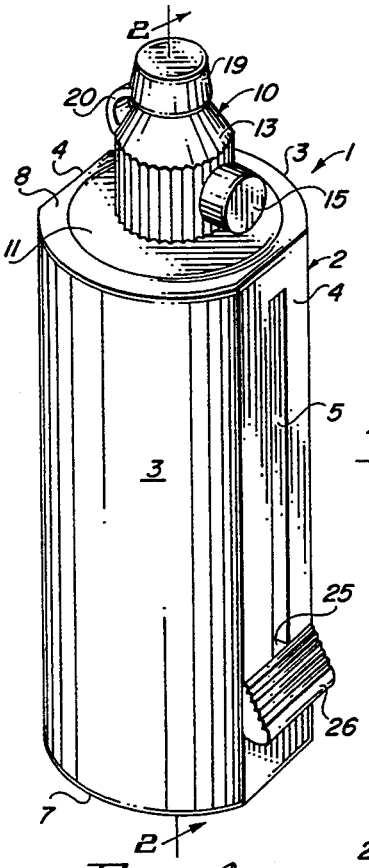
FIG. 1 is a perspective view of a preferred embodiment of the toothpaste dispensing apparatus of this invention.
Figure 3:
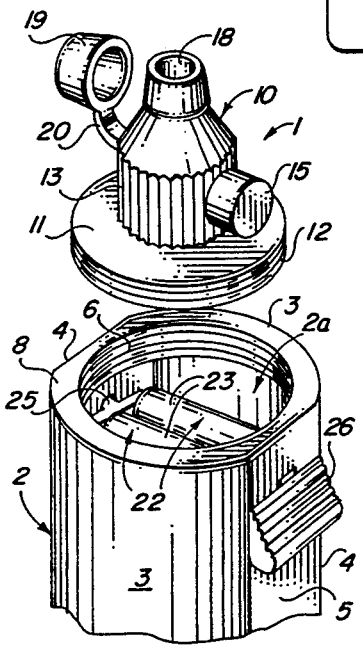
FIG. 3 is an exploded view of the top section of the toothpaste dispensing apparatus in FIG. 1, more particularly illustrating a preferred threaded attachment of the cap to the container.

As further illustrated in FIGS. 2 and 4 of the drawing, a conventional disposable toothpaste tube 30, containing a supply of toothpaste (not illustrated) is inserted in the container interior 2*a* of the container 2 after the toothpaste tube spout cap (not illustrated) is removed from the tube spout 30a and spout threads 32, and the cap 10 is unthreaded from the top of the container 2, as illustrated in FIG. 3. The substantially flat, sealed end of the tube body 31 of the toothpaste tube 30 is inserted between the rotatable contact cylinders 23 of the tube rollers 22, as the external roller tabs 26 are grasped by the fingers and forced downwardly in the respective wall slots 5 against the bias of the two roller springs 27, from the position illustrated in FIG. 3 to the position illustrated in FIG. 1. The cap 10 is then replaced on the container 2, as illustrated in FIGS. 1 and 2. Accordingly, when finger pressure is released from the roller tabs 26, the contact cylinders 23 of the tube rollers 22 now contact the tube body 31 of the toothpaste tube 30 and force the tube spout 30*a* of the toothpaste tube 30 upwardly against the valve 15, with the tube shoulder pressed against an o-ring tube seal 33 provided in the cap base 11 of the cap 10, as illustrated in FIG. 2. As further illustrated in FIG. 2, the toothpaste dispensing opening (not illustrated) in the tube spout 30*a* of the toothpaste tube 30 is blocked by a normally closed, flattened portion of the valve 15 which extends between the valve spring 17 and the transverse valve opening 16, such that toothpaste located within the toothpaste tube 30 cannot normally exit the toothpaste tube 30 through the open tube spout 30*a*. The contact cylinders 23 of the tube rollers 22 now constantly press against the tube body 31 of the toothpaste tube 30, as illustrated in FIGS. 2 and 4 and apply pressure to the toothpaste located in the toothpaste tube 30.

In operation, when it is desired to selectively dispense a controlled quantity of toothpaste from the tube spout 30*a* of the toothpaste tube 30, the aperture cap 19 is first removed from the dispensing aperture 18 of the cap 10 to clear the dispensing aperture 18. The projecting end of the valve 15 is then pressed to slide the valve 15 inside the valve base aperture 14 of the valve base 13, against the bias of the valve spring 17 and align the transverse opening 16 with the dispensing aperture 18 and the opening in the tube spout 30*a* of the toothpaste tube 30. Since pressure is constantly applied to the tube body 31 of the toothpaste tube 30 by means of the two tube rollers 22 and the tension in the corresponding parallel roller springs 27, toothpaste is forced from the tube spout 30*a*, through the valve opening 16 and into the dispensing aperture 18 of the cap 10, for dispensing onto a toothbrush (not illustrated). When a selected quantity of toothpaste has been dispensed onto the toothbrush from the dispensing aperture 18, finger pressure is released from the valve 15. This allows the valve 15 to again slide inside the valve base aperture 14 and misalign the valve opening 16 with the dispensing aperture 18 and the opening in the tube spout 30*a* of the toothpaste tube 30 by operation of the valve spring 17, to again close the tube spout 30*a*. The aperture cap 19 can then be replaced on the cap 10 to seal the dispensing aperture 18 and prevent residual toothpaste located in the dispensing aperture 18 from hardening. As illustrated in FIG. 2, the tube rollers 22 constantly engage both sides of the tube body 31 of the toothpaste tube 30 and thus, slowly rise to flatten the tube body 31 as toothpaste is dispensed on demand from the tube spout 30*a*. When the tube rollers 22 reach the upper area of the container interior 2*a*, the roller coil springs 27 lose their tension and the toothpaste tube 30 is removed from the container 2 and discarded.

It will be appreciated by those skilled in the art that the toothpaste dispensing apparatus of this invention is convenient and easy to use and may be constructed of any desired material, typically plastic, having selected decorative indicia which is suitable for use in a bathroom. Furthermore, the toothpaste dispensing apparatus can be used to dispense toothpaste from substantially any conventional disposable toothpaste tube, regardless of construction and size. Moreover, the toothpaste dispensing apparatus of this invention is easily cleaned, requires little or no maintenance and is easy to use by persons of all ages.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A toothpaste dispensing apparatus for dispensing toothpaste from a tube, comprising a container for receiving the tube; a pair of slots longitudinally provided in oppositely-disposed relationship with respect to each other in said container; roller means disposed for longitudinal travel in said container and engaging the tube; bias means provided in said housing and engaging said roller means for biasing said roller means toward an outlet of said tube; and tab means extending through said slots in said container, said tab means connected to said roller means for permitting retraction of the roller means against the bias of the biasing means to enable loading the tube in said container, whereby toothpaste is forced from the tube responsive to said biasing of said roller means toward the tube outlet.

2. The toothpaste dispensing apparatus of claim 1 comprising a cap removably provided on said housing and valve means mounted in said cap, said valve means communicating with said tube outlet, whereby the toothpaste is selectively dispensed from said cap responsive to manipulation of said valve means.

3. The toothpaste dispensing apparatus of claim 1 wherein said bias means comprises a pair of coil springs positioned in said container adjacent to said slots, respectively, each of said coil springs having one end secured to said container and the opposite end of said coil springs attached to said tab means, respectively, for biasing said roller means toward the tube outlet.

4. The toothpaste dispensing apparatus of claim 1 wherein said bias means comprises a pair of coil springs positioned in said container adjacent to said slots, respectively, each of said coil springs having one end secured to said container and the opposite end of said coil springs attached to said tab means, respectively, for biasing said roller means against the tube, and comprising a cap removably provided on said housing and valve means mounted in said cap, said valve means communicating with said tube outlet, whereby the toothpaste is selectively dispensed from said cap responsive to manipulation of said valve means and biasing of said roller means toward the tube outlet by said coil springs.

5. The toothpaste dispensing apparatus of claim 1 wherein said roller means comprises a pair of rollers disposed on each side of the tube, each of said rollers further comprising a roller pin fixed to said tab means and a contact cylinder rotatably carried by said roller pin, whereby said contact cylinder rotates on said roller pin, respectively, and said contact cylinder traverses the tube responsive to tension in said bias means.

6. The toothpaste dispensing apparatus of claim 5 comprising a cap removably provided on said housing and valve means mounted in said cap, said valve means communicating with said tube outlet, whereby the toothpaste is selectively dispensed from said cap responsive to manipulation of said valve means.

7. The toothpaste dispensing apparatus of claim 5 wherein said bias means comprises a pair of coil springs positioned in said container adjacent to said slots, respectively, each of said coil springs having one end secured to said container and the opposite end of said coil springs attached to said tab means, respectively, for biasing said contact cylinder toward the tube outlet.

8. The toothpaste dispensing apparatus of claim 5 wherein said bias means comprises a pair of coil springs positioned in said container adjacent to said slots, respectively, each of said coil springs having one end secured to said container and the opposite end of said coil springs attached to said tab means, respectively, for biasing said contact cylinder toward the tube outlet, and comprising a cap removably provided on said housing and valve means mounted in said cap, said valve means communicating with said tube outlet, whereby the toothpaste is selectively dispensed from said cap responsive to manipulation of said valve means and biasing of said contact cylinder toward the tube outlet by said coil springs.

9. The toothpaste dispensing apparatus of claim 2 comprising closure means removably applied to said cap for removably sealing said cap.

10. The toothpaste dispensing apparatus of claim 9 wherein said bias means comprises a pair of coil springs positioned in said container adjacent to said slots, respectively, each of said coil springs having one end secured to said container below said cap and the opposite end of said coil springs attached to said tab means, respectively, for biasing said roller means toward the tube outlet.

11. The toothpaste dispensing apparatus of claim 9 wherein said roller means comprises a pair of rollers disposed on each side of the tube, each of said rollers further comprising a roller pin fixed to said tab means and a contact cylinder rotatably carried by said roller pin, whereby said contact cylinder rotates on said roller pin, respectively, and said contact cylinder traverses the tube responsive to tension in said bias means.

12. The toothpaste dispensing apparatus of claim 9 wherein:

(a) said bias means comprises a pair of coil springs positioned in said container adjacent to said slots, respectively, each of said coil springs having one end secured to said container below said cap and the opposite end of said coil springs attached to said tab means, respectively, for biasing said roller means toward the tube outlet ; and (b) said roller means comprises a pair of rollers disposed on each side of the tube, each of said rollers further comprising a roller pin fixed to said tab means and a contact cylinder rotatably carried by said roller pin, whereby said contact cylinder rotates on said roller pin, respectively, and said contact cylinder traverses the tube responsive to tension in said coil springs.

13. A toothpaste dispensing apparatus for removably receiving a toothpaste tube having a dispensing end and semi-automatically dispensing a controlled quantity of toothpaste from the dispensing end of the toothpaste tube, said toothpaste dispensing apparatus comprising an upright, vertical container for removably accommodating the toothpaste tube, with the dispensing end of the toothpaste tube facing upwardly; a pair of vertically-oriented slots provided in said container in oppositely-disposed, substantially parallel relationship with respect to each other; a pair of rollers disposed transversely in said container between said slots, said rollers normally engaging the toothpaste tube and disposed for operational rotation against the toothpaste tube along substantially the length of said container; a pair of tabs extending through said slots, respectively, said tabs receiving said rollers in rotatable relationship, and said tabs further adapted to traverse said slots, respectively, as said rollers traverse the toothpaste tube; bias means provided in said container, with one end of said bias means fixed to said container and the opposite ends of said bias means connected to said tabs, respectively, said bias means operable to apply constant upward pressure on said rollers and the toothpaste tube; cap means threadably closing said container and a toothpaste dispensing aperture provided in said cap means, said toothpaste dispensing aperture communicating with the dispensing end of, the toothpaste tube; and valve means provided in said cap means and said toothpaste dispensing aperture for selectively opening and closing said toothpaste dispensing aperture and allowing toothpaste to flow in controlled quantities from the dispensing end of the toothpaste tube through said toothpaste dispensing aperture responsive to said constant upward pressure of said rollers on the toothpaste tube by tension in said bias means.

14. The toothpaste dispensing apparatus of claim 13 comprising closure means removably applied to said cap means for removably sealing said toothpaste dispensing aperture in said cap means.

15. The toothpaste dispensing apparatus of claim 13 wherein said bias means comprises a pair of coil springs positioned in said container adjacent to said slots, respectively, each of said coil springs having one end secured to said container and the opposite end of said coil springs attached to said tabs, respectively, for biasing said rollers against the toothpaste tube.

16. The toothpaste dispensing apparatus of claim 13 comprising closure means removably applied to said cap means for removably sealing said toothpaste dispensing aperture in said cap means and wherein said bias means comprises a pair of coil springs positioned in said container adjacent to said slots, respectively, each of said coil springs having one end secured to said container beneath said cap means and the opposite end of said coil springs attached to said tabs, for biasing said rollers against the toothpaste tube.

17. The toothpaste dispensing apparatus of claim 13 wherein each of said rollers further comprises a roller pin fixed to said tabs and a contact cylinder rotatably carried by said roller pin, whereby said contact cylinder rotates on said roller pin, respectively, and said contact cylinder traverses the tube responsive to said tension in said bias means.

18. The toothpaste dispensing apparatus of claim 17 comprising closure means removably applied to said cap means for removably sealing said dispensing aperture in said cap means and wherein said bias means comprises a pair of coil springs positioned in said container adjacent to said slots, respectively, each of said coil springs having one end secured to said container and the opposite end of said coil springs attached to said tabs, for biasing said contact cylinder against the tube.

19. A toothpaste dispensing apparatus for removably receiving a toothpaste tube having a dispensing end and semi-automatically dispensing a controlled quantity of toothpaste from the dispensing end of the toothpaste tube, said toothpaste dispensing apparatus comprising an upright container for removably accommodating the toothpaste tube, with the dispensing end of the toothpaste tube facing upwardly; a pair of elongated, vertical slots provided in said container in oppositely-disposed, substantially parallel relationship with respect to each other; a pair of rollers disposed transversely in said container between said slots, said rollers engaging the toothpaste tube and disposed for rotation against the toothpaste tube along substantially the length of said slots; a pair of tabs extending through said slots, respectively, said tabs receiving said rollers in rotatable relationship, said tabs further adapted to traverse said slots, respectively, as said rollers traverse the toothpaste tube; a pair of coil springs provided in said container, with one end of each of said coil springs fixed to said container and the opposite ends of said coil springs connected to said tabs, respectively, said coil springs operable to apply constant upward pressure on said rollers and the toothpaste tube; cap means threadably closing said container and a toothpaste dispensing aperture provided in said cap means, said toothpaste dispensing aperture communicating with the dispensing end of the toothpaste tube; and valve means provided in said cap means and communicating with said toothpaste dispensing aperture and the dispensing end of the toothpaste tube, for selectively opening and closing said toothpaste dispensing aperture and allowing toothpaste to flow in controlled quantities from the dispensing end of the toothpaste tube through said toothpaste dispensing aperture, responsive to said constant upward pressure of said rollers on said toothpaste tube by operation of said coil springs.

20. The toothpaste dispensing apparatus of claim 19 comprising closure means removably applied to said cap means for removably sealing said toothpaste dispensing aperture in said cap means.

* * * * *